United States Patent [19]

Laramee

[11] Patent Number: 4,798,747

[45] Date of Patent: Jan. 17, 1989

[54] DISPOSABLE WARNING MARKER APPARATUS

[76] Inventor: Camille A. Laramee, 30 Andros Pl., Dania, Fla. 33004

[21] Appl. No.: 107,557

[22] Filed: Oct. 13, 1987

[51] Int. Cl.[4] ..... B65D 5/00

[52] U.S. Cl. ..... 428/12; 116/63 C; 229/116; 229/185; 428/542.8

[58] Field of Search ..... 428/542.8, 9, 12; 229/116, 156, 185; 116/63 C

[56] References Cited

U.S. PATENT DOCUMENTS

| | | | |
|---|---|---|---|
| 490,680 | 1/1893 | Roberts | 428/542.8 X |
| 550,247 | 11/1895 | Buch | 428/542.8 X |
| 781,082 | 1/1905 | Morris | 229/185 X |
| 1,597,757 | 8/1926 | Berger | 229/116 X |
| 1,861,206 | 5/1932 | Burgess | 428/542.8 X |
| 2,167,917 | 8/1939 | Vogt | 229/156 X |
| 2,935,238 | 5/1960 | Koehler | 229/116 |
| 3,885,266 | 5/1975 | Nafziger | 428/542.8 X |
| 4,084,015 | 4/1978 | Patterson | 428/542.8 X |

FOREIGN PATENT DOCUMENTS

| | | | |
|---|---|---|---|
| 3011149 | 10/1981 | Fed. Rep. of Germany | 428/542.8 |

*Primary Examiner*—Henry F. Epstein
*Attorney, Agent, or Firm*—John A. Haug

[57] ABSTRACT

A semi-finished sheet for making disposable warning marker devices is shown having three major side panels of trapezoidal configuration and a minor bottom panel of triangular configuration. The sheet is foldable along fold lines with tabs lockably received in mating slots to form a frusto pyramid structure open at the top to facilitate insertion of suitable weights to enhance stability.

5 Claims, 1 Drawing Sheet

DISPOSABLE WARNING MARKER APPARATUS

This invention relates generally to marker devices for alerting or warning of some dangerous or unusual condition at particular locations and more particularly to such devices which are of low cost and easily stored and handled.

Warning marker devices in the form of cones mounted on rectangular bases are well known. Such cones are generally hollow devices formed of plastic material to facilitate stacking in order to store the devices in a minimum amount of space. Such cones are used for sundry purposes including marking of outdoor work sites such as sewer and road work, electric or telephone work, construction sites as well as indoor work sites such as supermarkets, to warn people of wet floors or spills and so on.

Although these devices have become relatively inexpensive when only a few are required, when it is necessary to use a large quantity, the cost becomes significant. Further, even though the cones are stackable, they still are bulky requiring considerable space for storage as well as for deployment from a truck or the like.

SUMMARY OF THE INVENTION

It is an object of the present invention to provide a warning marker device which is very inexpensive, easily stored and easily handled. Yet another object is the provision of a warning marker device which is suitable for repeated use yet sufficiently inexpensive that it can be disposed after a single use if desired.

Briefly, according to the invention a semi-finished sheet of biodegradable material, such as corrugated cardboard, is formed having three essentially identical major side panels, trapezoidal in configuration, having parallel top and bottom portions and a minor bottom panel, triangular in configuration, integrally attached to the bottom portion of one of the major panels. One of the major panels is integrally attached to and is disposed intermediate the other two major panels and demarcated by respective fold lines. A fold line also demarcates the bottom panel from the major panel to which it is attached. The outer side portions of one of the outer major panels has a closure flap in which a slot is formed and the outer side portion of the other outer major panel has a locking tab which is receivable in the slot when the panels are folded. In like manner closure flaps extend from the bottom portion of the other two major panels with a slot formed in each flap and locking tabs extend from the bottom panel receivable in the slots of the closure flap extending from the bottom portions of the major panels.

According to a feature of the invention the closure flaps have tapered side portions which are spaced from the extremities of the panel to which they are attached a distance generally equal to the thickness of the sheet. According to another feature the locking tabs have a first portion which is integrally attached to a respective panel with a length generally equal to the length of its corresponding slot and a second portion with a length greater than that of its corresponding slot with the second portion spaced from its respective panel a distance approximately equal to the thickness of the sheet.

BRIEF DESCRIPTION OF THE DRAWINGS

These and other objects and advantages of the present invention will become more fully apparent from the following detailed description when read in conjunction with the accompanying drawings.

DESCRIPTION OF THE PREFERRED EMBODIMENT

Figure 1:
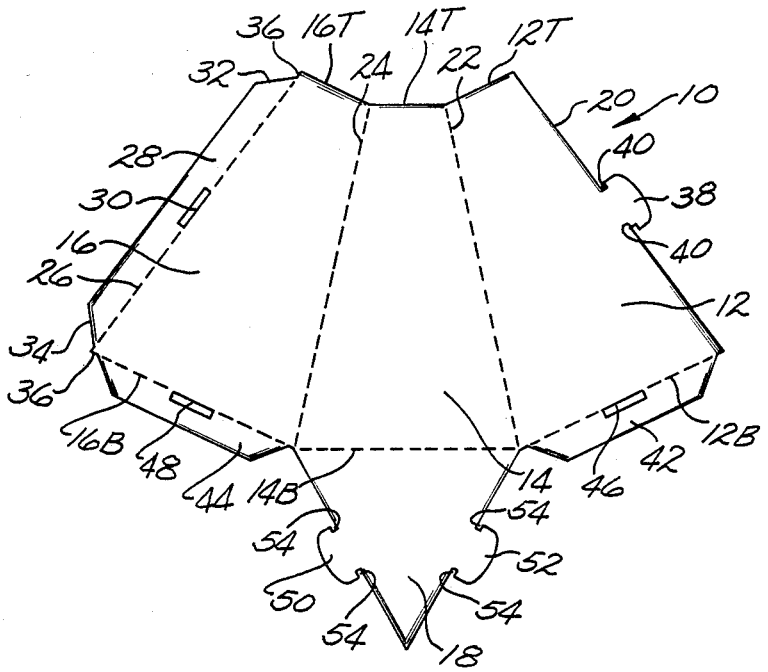
FIG. 1 is a top plan view of the semi-finished sheet made in accordance with the invention.
Figure 2:
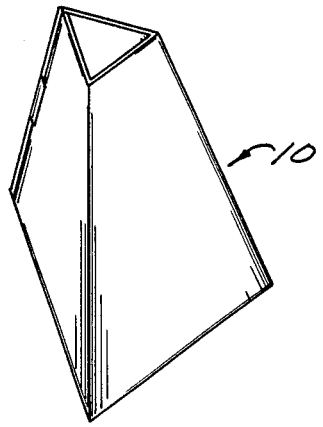
FIG. 2 is a perspective view of the FIG. 1 sheet assembled to form a warning marker device.

Referring now to the preferred embodiment as shown in FIGS. 1 and 2 device 10 comprises essentially identical first, second and third major panels 12, 14, and 16 and a minor panel 18. Panels 12, 14, and 16 are trapezoidal in configuration having parallel top and bottom portions 16T, 14T, 12T and 16B, 14B, 12B respectively. Panel 12 has an outer side edge 20 and an inner edge defined by a fold line 22. Panel 14 has opposite side edges defined by fold lines 22, 24, while panel 16 has a side edge defined by fold line 24 and an outer edge defined by fold line 26. Outwardly disposed of fold line 26 is a closure flap 28 formed with a slot 30 having one edge coincident with fold line 26 and its parallel edge spaced outwardly therefrom. Closure flap 28 has tapered sides 32, 34 which meet panel 26 at a distance from the panel's top and bottom portions generally equal to the thickness of the sheet material, as noted at 36.

Projecting from outer edge 20 of panel 12 is a locking tab 38 formed with cut away portions 40 contiguous with edge 20 with the length of tab 38 at edge portion 20 being approximately equal to the length of slot 30 and the remaining portion of tab 88 extending beyond. The depth of the cut away portion is generally equal to the thickness of the sheet. Locking tab 38 is positioned along edge 20 so that it is aligned with slot 30 when the panels are folded as will be explained infra.

Similarly closure flap 42 extends downwardly from bottom fold line 12B and closure flap 44 extends downwardly from fold line 16B. Closure flap 42 is provided with a slot 46 having one length extending edge lying on the fold line 12B and a parallel edge spaced outwardly therefrom. A similar slot 48 in closure panel 44 has one length extending edge lying on the fold line 16B and a parallel edge spaced outwardly therefrom. Both closure panels are tapered joining panels 12 and 16 respectively at a point spaced approximately a distance from either end equal to the thickness of the sheet material.

Triangular bottom panel 18 is joined to panel 14 by fold line 14B and has locking tabs 50, 52 projecting outwardly from its other two side edges. Tabs 50, 52 are each cut away at 54 so that the length of the tab at the point of connection with its respective panel is approximately equal to the slots 46, 48 and having a depth approximately equal to the thickness of the panel.

FIG. 2 shows the FIG. 1 sheet assembled to form a warning marker device by bending the panels and closure flap along their respective folding lines and inserting the locking tabs into their corresponding slots. It will be noted that the second portion of the locking tab which has a length greater than the length of its corresponding slot serves to provide a positive lock to prevent accidental dislodgement. Spacing of the closure flap from the extremities of their respective panels a distance generally equal to the thickness of the sheet results in a flush fitting of the panels relative to one another. The open top provided by the trapezoidal configuration forming the frusto pyramid configuration facilitates the placement of weights, such as sand, stones, or the like, within the marker to enhance it's stability.

It will be seen that the sheets which may conveniently be formed by stamping from a blank sheet of suitable coloration, can be stored in a minimum of space by piling the flat sheets on one another until ready for use. The sheets cost only a small fraction of the plastic cones in conventional use and can either be taken apart if desired for convenient storage or can be discarded (at the site and allowed to degrade through the action of the elements).

While there has been illustrated and described what at present is considered to be the preferred embodiment of the present invention it will be understood by those skilled in the art that various changes and modifications may be made and equivalents may be substituted for elements thereof without departing from the true scope of the invention. It is intended that the invention will include all embodiments falling within the scope of the appended claims.

What is claimed is:

1. A semi-finished sheet for making disposable warning marker devices having first, second, and third essentially identical major panels, each major panel being trapezoidal in shape having parallel top and bottom portions, the second panel disposed intermediate the first and third panels, the first and third panels having inner and outer sides, a respective fold line separating the first and second panels and the second and third panels, the fold lines forming the respective inner sides, a locking tab projecting outwardly from the outer side of the first panel, a closure flap extending outwardly from the third panel, a slot formed in the closure panel along the outer portion of the third panel, the locking tab and the slot disposed the same distances from the top portion of the respective panel to which the tab and slot is associated, a minor panel extending outwardly from the bottom portion of the second panel, the minor panel being triangular in shape and having first and second free side portions, a fold line separating the minor panel from the second panel, a respective closure flap extending outwardly from the bottom portions of the first and second panels, a slot formed in each closure flap extending form the bottom portion a selected distance from the second panel, a locking tab projecting outwardly from each of the first and second free sides the selected distance from the second panel whereby the locking tab projecting from the first panel is lockably insertable in the slot formed in the closure flap extending from the third panel by folding the major panels on their respective fold lines and the locking tabs projecting from the free sides of the minor panel are lockably inserted in the respective slot formed in the closure flaps extending from the bottom portion of the first and second panels, each locking tab having a first portion with a length between first and second ends generally the same as the length of its respective slot and a second portion with a length greater than the length of its respective slot and extending beyond both first and second ends of the first portion, the second its respective panel being spaced from the first portion a distance generally equal to the thickness of the sheet.

2. A semi-finished sheet according to claim 1 in which the closure flaps have tapered side portions.

3. A semi-finished sheet for making disposable warning marker devices having first, second, and third essentially identical major panels, each major panel being trapezoidal in shape having parallel top and bottom portions, the second panel disposed intermediate the first and third panels, the first and third panels having inner and outer sides, a respective fold line separating the first and second panels and the second and third panels, the fold lines forming the respective inner sides, a locking tab projecting outwardly from the outer side of the first panel, a closure flap extending outwardly from the third panel spaced from the top and bottom portions of the third panel a distance at least equal to the thickness of the sheet, a slot formed in the closure panel along the outer portion of the third panel, the locking tab and the slot disposed the same distances from the top portion of the respective panel to which the tab and slot is associated, a minor panel extending outwardly from the bottom portion of the second panel, the minor panel being triangular in shape and having first and second free side portions, a fold line separating the minor panel from the second panel, a respective closure flap extending outwardly from the bottom portions of the first and second panels, a slot formed in each closure flap extending from the bottom portion a selected distance from the second panel, a locking tab projecting outwardly from each of the first and second free sides the selected distance from the second panel whereby the locking tab projecting from the first panel is lockably insertable in the slot formed in the closure flap extending from the third panel by folding the major panels on their respective fold lines and the locking tabs projecting from the free sides of the minor panel are lockably inserted in the respective slot formed in the closure flaps extending from the bottom portion of the first and second panels.

4. A semi-finished sheet according to claim 3 in which the closure flaps extending from the bottom portions of the first and third panels are spaced from the side portions of the panels a distance at least equal to the width of the sheet.

5. A semi-finished sheet according to claim 3 in which each locking tab has a first portion with a length generally the same as the length of its respective slot and a second portion with a length greater than the length of its respective slot, the second portion spaced from its respective panel a distance generally equal to the thickness of the sheet.

* * * * *